US005521578A

United States Patent [19]

DelValle

[11] Patent Number: 5,521,578

[45] Date of Patent: May 28, 1996

[54] DISPLAY AND CONTROL DEVICE FOR HOMES, APARTMENTS, AND OTHER BUILDINGS

[76] Inventor: Ivan DelValle, 3212 Harrison Rd., Montgomery, Ala. 36109

[21] Appl. No.: 251,657

[22] Filed: May 31, 1994

Related U.S. Application Data

[63] Continuation of Ser. No. 895,024, Jun. 8, 1992, abandoned, which is a continuation-in-part of Ser. No. 648,824, Jan. 31, 1991, abandoned.

[51] Int. Cl.[6] ..... G08B 5/00

[52] U.S. Cl. ..... 340/330; 340/286.01; 340/326; 340/331; 340/332; 340/815.47; 340/815.5; 340/815.53

[58] Field of Search ..... 340/330, 326, 340/286.01, 331, 332, 815.2, 815.14, 815.15, 815.17, 815.12, 815.47, 815.49, 815.5, 815.53

[56] References Cited

U.S. PATENT DOCUMENTS

| | | | |
|---|---|---|---|
| 2,316,856 | 4/1943 | Green | 340/330 |
| 3,135,953 | 6/1964 | Bagno | 340/330 |
| 3,159,827 | 12/1964 | Wellein | 340/330 |
| 4,011,560 | 3/1977 | Mason et al. | 340/815.12 |
| 4,587,753 | 5/1986 | Harper | 340/331 |
| 4,686,505 | 8/1987 | Vanderburg | 340/331 |
| 4,901,461 | 2/1990 | Edwards et al. | 340/331 |
| 5,043,716 | 8/1991 | Latz et al. | 340/815.31 |

FOREIGN PATENT DOCUMENTS

| | | | |
|---|---|---|---|
| 2093241 | 8/1982 | United Kingdom | 340/326 |

*Primary Examiner*—Brent A. Swarthout
*Assistant Examiner*—Edward Lefkowitz
*Attorney, Agent, or Firm*—Larson & Taylor

[57] ABSTRACT

A combination address display device and doorbell control assembly are provided wherein the doorbell control assembly controls the supply of power to a backlighting assembly of the display device from existing wiring for the doorbell. The display device comprises a flat modular housing which pivots open to permit insertion of a display sandwich therein. The latter includes a sheet containing address numerals and the like a well as protective and appearance enhancing sheets. The backlighting assembly includes a reflector element having stepped openings therein in registration with the address numerals. The doorbell assembly includes a pair of lighted pushbuttons for controlling actuation of the doorbell and a lamp that directs a light beam below the assembly for use in finding one's keys or a similar purpose.

19 Claims, 13 Drawing Sheets

DISPLAY AND CONTROL DEVICE FOR HOMES, APARTMENTS, AND OTHER BUILDINGS

CROSS REFERENCE TO RELATED APPLICATIONS

This application is a continuation of application Ser. No. 07/895,024 filed Jun. 8, 1992 which is a Continuation-in-Part of U.S. Ser. No. 07/648,824 filed Jan. 31, 1991, both now abandoned.

FIELD OF THE INVENTION

The present invention relates to display and control devices for homes, apartments and other buildings and, more particularly, to an improved address display device and associated doorbell assembly both of which also have separate utility.

BACKGROUND OF THE INVENTION

Addresses of homes or businesses are commonly displayed by simply painting the numbers (and sometimes the associated street name, resident's name or other information) on a curb, post, sign or mailbox, by attaching numerals (and letters) made of various materials to the building or other exterior structure, and by providing a lighted boxed display mounted on a base or post. The latter displays can be powered using solar energy. Most displays suffer obvious disadvantages including a lack of readability at night and those displays which are lit up or otherwise made visible at night have various problems of their own.

Doorbell control units typically comprise a single pushbutton or the like which, when actuated, provides completion of a doorbell or chimes circuit to produce the sounding of a bell, buzzer or similar device and to thus provide announcement of a visitor. While such units, in general, serve their intended purposes, these units do not provide the various features and advantages of the invention discussed below.

SUMMARY OF THE INVENTION

In accordance with the invention, there is provided a backlight display device for displaying an address, name, logo, message or the like, in association with a doorbell control assembly that also controls the power supplied to the backlighting unit of the display device from existing doorbell wiring. The display device, which has utility separate from the doorbell control assembly, is durable and economical to manufacture, and affords protection against weather as well as the ultraviolet rays of the sun. The device is energy efficient and aesthetically pleasing in appearance. Moreover, the modular construction of the display device adds to its adaptability and versatility.

The doorbell control assembly, which similarly has utility apart from the display device, provides a number of important advantages over conventional doorbells. For example, the doorbell control assembly of the invention includes an illuminated pushbutton or other actuator for the doorbell unit itself, as well as a further illuminated pushbutton or other actuator for controlling activation of a light source such as a lamp (light bulb) that provides a diffused, focussed or directed light beam for illuminating a relatively small, discrete area around the assembly, preferably just below the assembly. This beam of light can be used, for example, to enable one to find his or her keys (or to identify a particular key), to see the keyhole better, to write a note or leave a message, or to perform a like task, by simply depressing the light control actuator. An emergency flasher assembly can also be connected through a control switch of the doorbell control assembly to existing electrical wiring so as to provide a flashing light in an emergency situation.

In accordance with one aspect of the invention, a display device is provided for displaying alphanumeric characters such as the numerals of an address, the device comprising: a housing module including a cover having a window therein; a thin, substantially flat carrier element mounted within the housing module and displaying alphanumeric characters through the window in the cover, at least part of the carrier element being at least partially light transmissive; at least one lamp disposed within the housing module behind the carrier element so as to provide illumination thereof; and reflector means, disposed within the housing module in back of the at least one lamp, for directing light from the lamp so as to provide illumination of the carrier element.

In one embodiment, the housing module includes a central or main frame member and the cover is pivotably secured to the frame member so as to be pivotable between a first, normal or closed position in engagement with the frame member and a second, lowered or open position that enables a carrier element to be inserted into the housing module.

In a further preferred embodiment, the cover is releasably connected, e.g., by a snap fit, with a rear frame or backing member and the carrier element is captured therebetween.

in one preferred embodiment, the reflector element preferably includes a plurality of formed cavities or recesses therein and at least some of the alphanumeric characters of the carrier element are individually disposed in registration with those openings. In accordance with an important feature of the invention, the cavities or recesses of the reflector element include stepped reflective side walls. Advantageously, the characters are seven segment numerical representations (as commonly used in digital displays) and the recesses in the reflector element include a central transverse bar having stepped reflective side walls so that the reflective side walls defining the recesses are of a shape substantially that of a squared-off numeral eight. Preferably, a pair of lamps is provided for each of the recesses.

In another preferred embodiment, the reflector means includes a reflector element comprising a strip forming a Fresnel lens made of a clear, i.e., light transparent material for scattering light, while in another preferred embodiment, the reflector means includes a rear reflective wall of the housing module and at least one opaque strip for confining the light.

In one preferred embodiment, the housing module further comprises a rear frame member secured to the cover and to the first mentioned (main) frame member. The carrier element is preferably part of a sandwich assembly further comprising at least one protective sheet for providing protection of the carrier element against weather and ultraviolet rays. In a further preferred embodiment, the carrier element is mounted on an intermediate frame member which is secured to the backing member mentioned above.

In accordance with a further aspect of the invention, a doorbell control assembly is provided which is adapted to be connected to a conventional doorbell unit through existing wiring, the doorbell control assembly comprising: a housing; a circuit board contained within the housing and including terminals adapted to be connected to the doorbell unit; a first pushbutton or like actuator mounted within the housing and extending outwardly therefrom so as to be depressible by a user; first contact means, disposed within the housing, for, responsive to the first pushbutton being depressed, engaging the terminals of the circuit board and causing an electrical circuit to be completed to the doorbell unit; a second pushbutton or like actuator mounted within the housing and extending outwardly therefrom so as to be depressible by user; a lamp mounted within the housing; light guide means for directing light from the lamp to an area just beneath or below the housing; and second contact means, disposed within the housing, for, responsive to the second pushbutton being depressed, completing a circuit including the lamp so as to provide energization of the lamp.

In a preferred embodiment, the assembly comprises a second lamp disposed within the housing behind the second pushbutton for, when energized, illuminating the second pushbutton and a further lamp disposed within the housing behind said first pushbutton for, when energized, illuminating the first pushbutton.

The light guide means advantageously includes a light focussing or diffusing lens which is preferably disposed at an inclined angle with respect to the housing and a reflector positioned behind the first-mentioned lamp.

As set forth above, in accordance with one embodiment, the doorbell control assembly is associated with the address display device which displays, e.g., numerals representative of the address at which the assembly is to be used and which includes an electrical circuit including at least one lamp for illuminating those numerals, and in this embodiment, the circuit board of the doorbell control assembly includes a fuse connected in series with that electrical circuit. In one implementation of this embodiment, the doorbell control assembly housing and the display device are integrally mounted.

Other features and advantages of the invention will be set forth in, or apparent from, the following detailed description of preferred embodiments of the invention.

DESCRIPTION OF THE PREFERRED EMBODIMENTS

Figure 1:
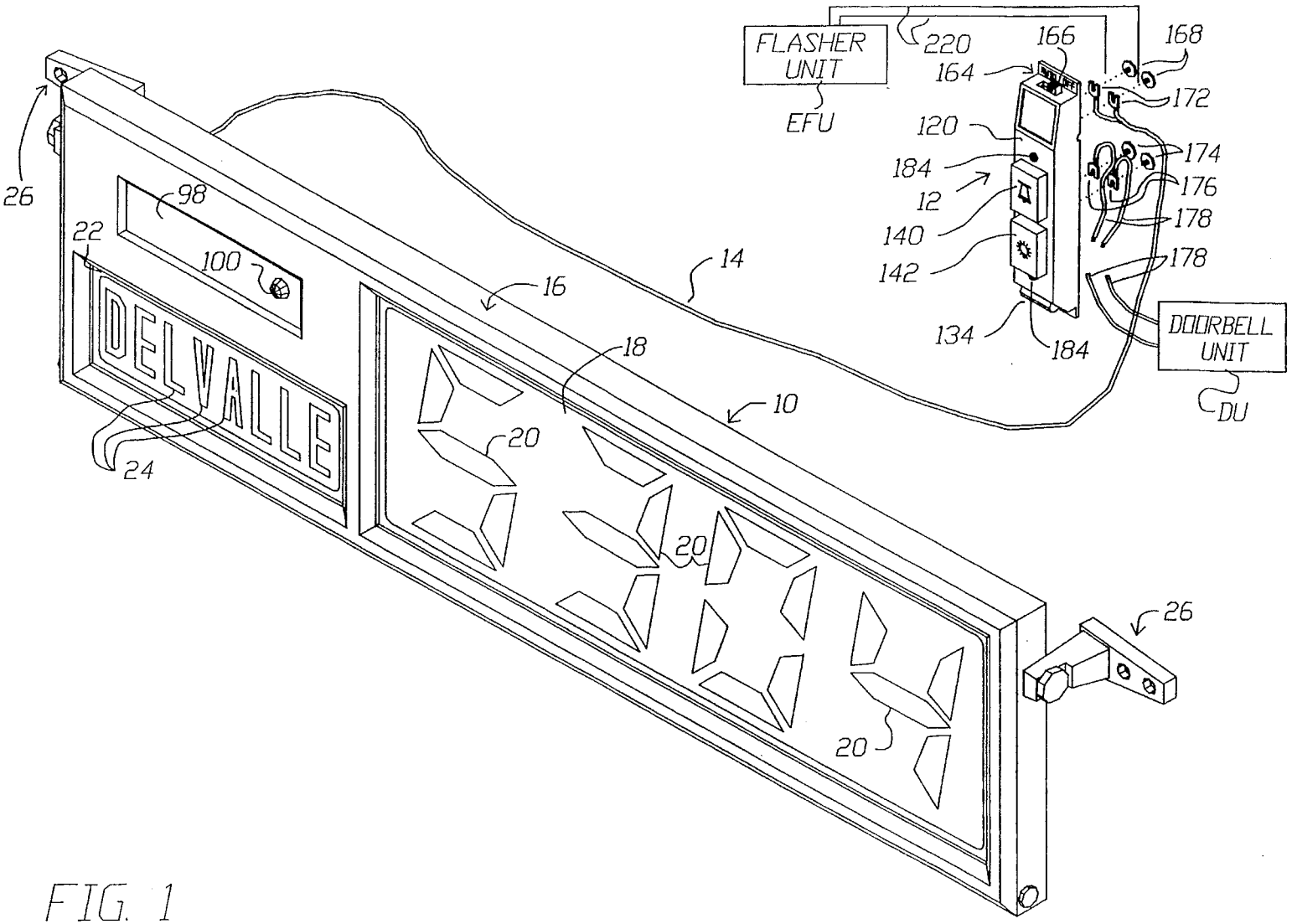
FIG. 1 is a front perspective view of a combination address display device and doorbell control assembly constructed in accordance with a preferred embodiment of the invention.

Referring to FIG. 1, a perspective view is provided of a combined address display device and doorbell control assembly constructed in accordance with a preferred embodiment of the invention. As set forth above, both the address display device, which is generally denoted 10, and the doorbell control assembly, which is generally denoted 12, have separate utility apart from one another but in the embodiment under consideration, the display device is powered from the doorbell assembly 12 and to this end, a electric cable 14 interconnects the two units.

Both the display device or unit 10 and doorbell control assembly 12 will be described in more detail below but as shown in FIG. 1, display unit 10 includes a substantially flat, i.e., thin profile, rectangular frame or body 16 having a first window 18 therein in which numerals 20 are displayed which represent, e.g., the house number of the user and a second smaller window 22 which normally contains alphanumeric FIGS. 24, e.g., letters, which, for example, spell out the last name of the user (i.e., "Delvalle" in this instance). It will be understood that in a simplified embodiment, only the numerals 20 representing the street number may be displayed, i.e., alphanumeric figures, i.e., letters, 24 could be eliminated. Mounting brackets 26 are provided at each end of frame 16 and are used to mount the frame 16 on the wall of a building or residence. A hanging mounting (not shown in FIG. 1) can also be used to suspend the frame 16 from a chain, rope or the like (not shown).

Figure 2:
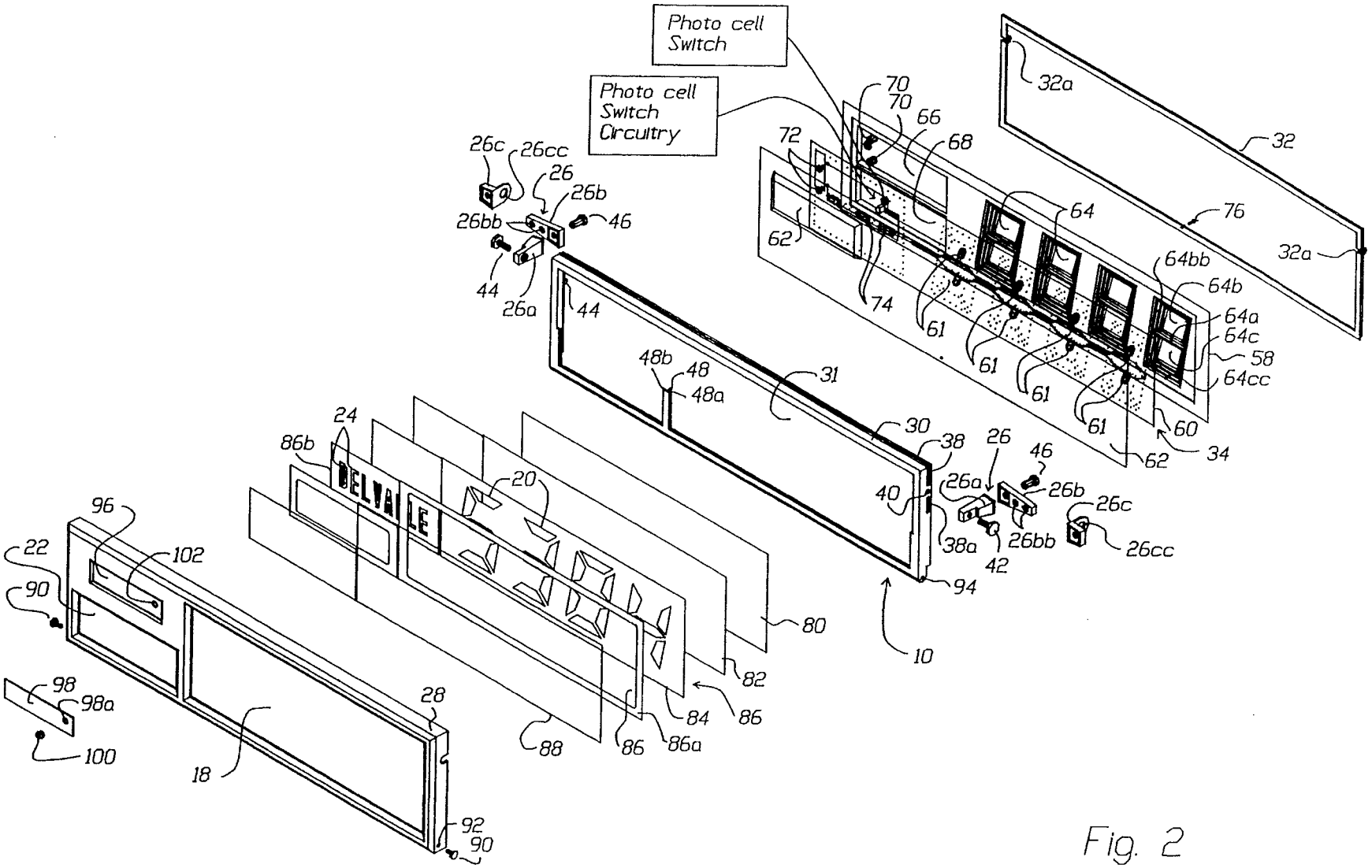
FIG. 2 is an exploded front perspective view of the display device of FIG. 1.

Referring to FIG. 2, an exploded perspective view of the display device 10 is shown. As will be evident from FIG. 2, frame 16 is made up of three basic framing or housing components, viz., a cover member or "beauty shell" 28, a central frame member 30, to which cover member 28 is pivotably connected, and a rear frame member 32. Between these components are captured and held a back-light assembly sandwich generally denoted 34 and an alphanumeric sandwich of inserts generally denoted 36.

Figure 3:
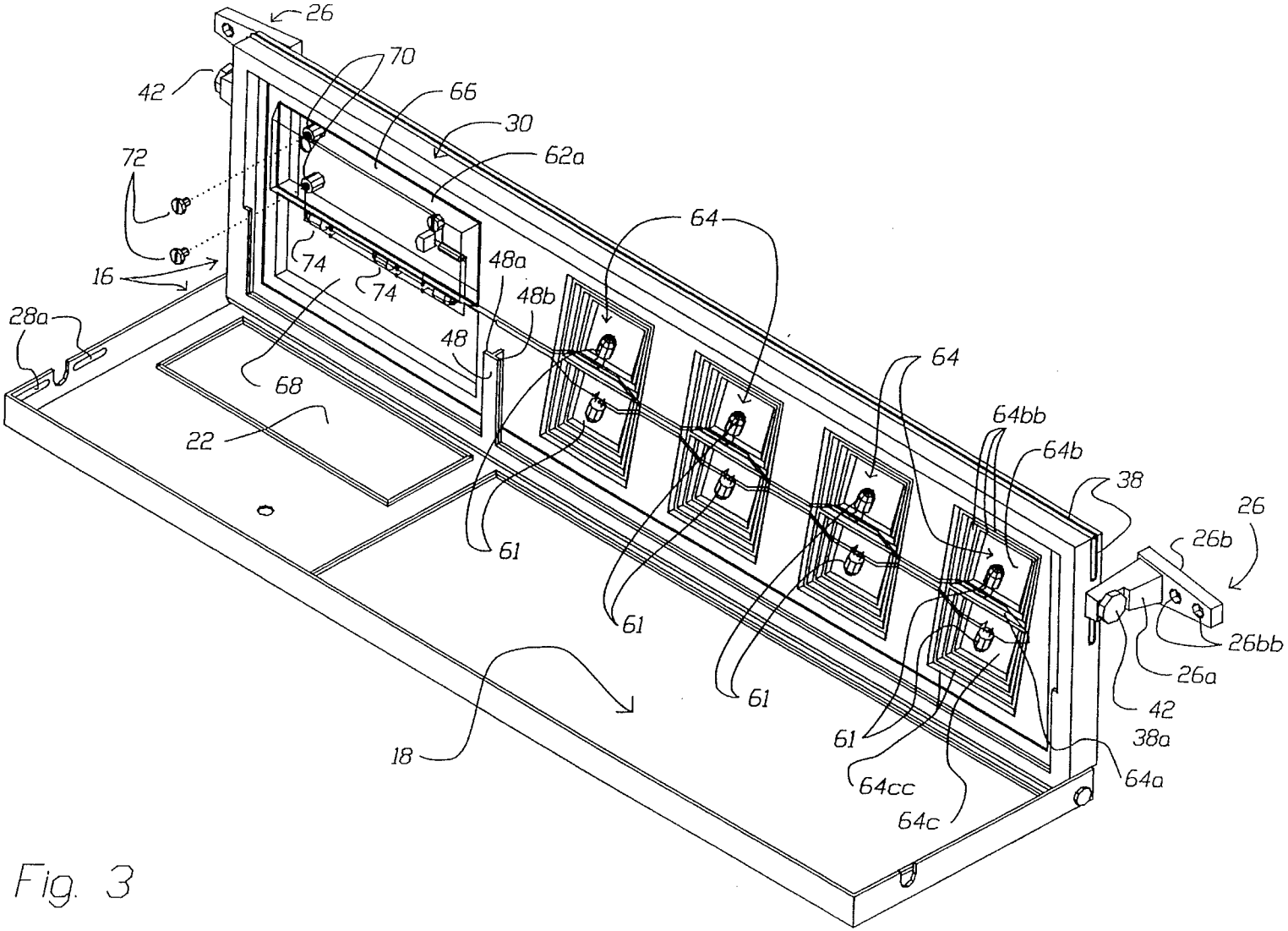
FIG. 3 is a front perspective view of the display device of FIG. 1 with the front cover lowered and the display sandwich removed to show the back-lighting assembly.
Figure 4:
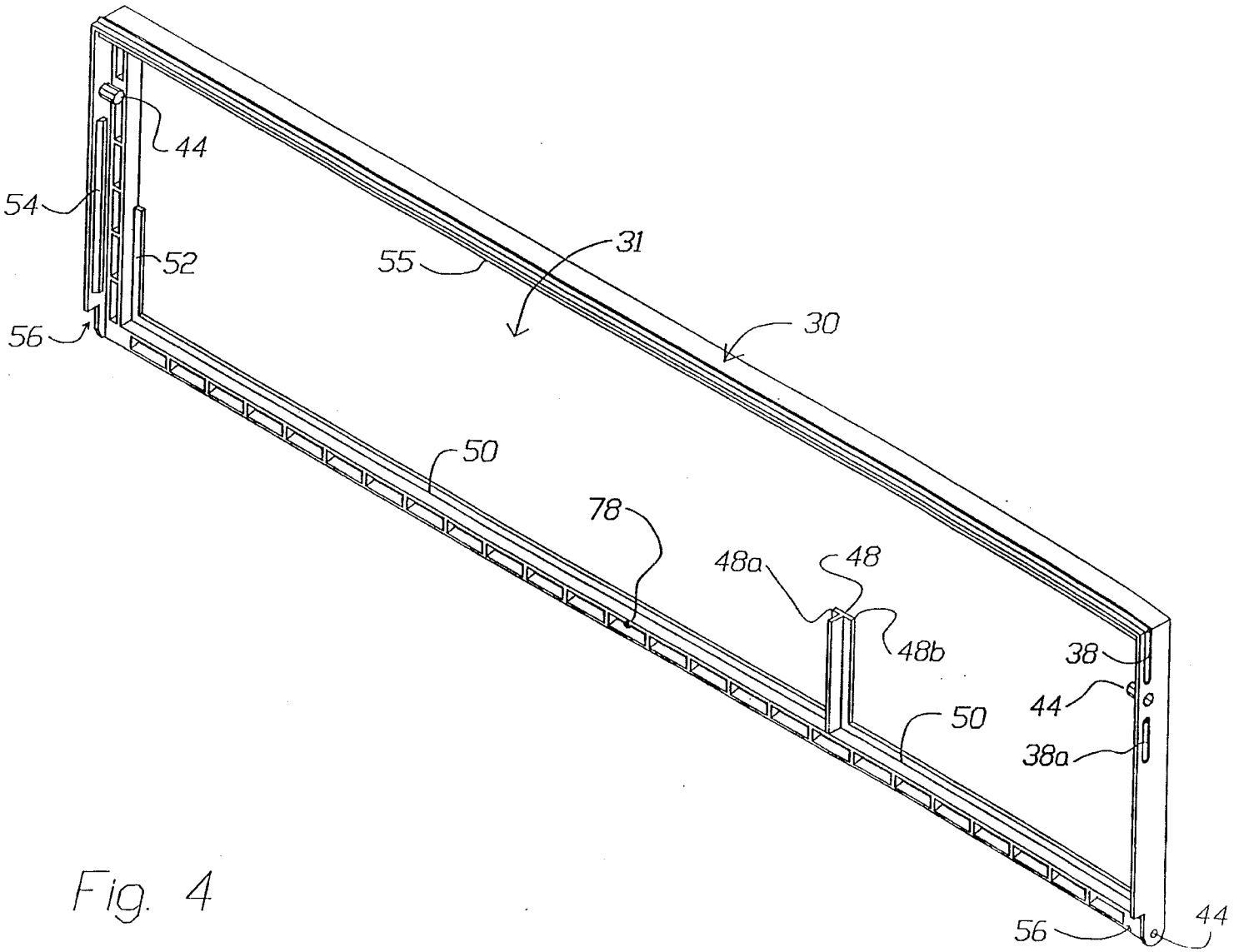
FIG. 4 is a rear perspective view of the central frame member of the display device of FIG. 1 to 3.

Referring first to central frame member 30, as shown in FIG. 2, and also in FIG. 3 and in FIG. 4, which is a rear perspective view of member 30, frame member 30 is basically of open rectangular shape including a central opening 31. A ridge 38 is provided along the top edge of frame 30 which also extends a short distance down each side edge and includes a short separated portion **38*a* (only one of which can be seen in FIGS. 2, 3 and 4) on each side edge, on the other side of, i.e., beneath, the respective brackets 26. Ridge 38 and associated side edge 38*a* service plural functions. In particular, ridge 38 creates a water dam for moisture, provides, in cooperation with cover member 28, a snap fit so that cover member 28 can be snapped close from the open position shown in FIG. 3, and retains cover member 28 in place when cover member 28** is closed.

Central frame member 30 also includes openings 40 located above ridge portions **38*a* in which bracket mounting screws 42 are received. Screws 42 are used to mount brackets 26 on frame member 30, and openings 40 are formed in small inwardly extending internally threaded cups or screw receptacles 44 best seen in FIG. 4 (one of which is shown at left side of FIG. 1) so that the distal ends of screws 42** are covered and not exposed.

As mentioned above, the mounting brackets for the display device can take at least two forms and in the exemplary embodiment illustrated in FIG. 2, bracket 26 is of a two-piece construction including a base part 26*a* through which a respective screw 44 extends, and one or the other of two mounting parts 26*b* and 26*c*. Mounting part 26*b* comprises a laterally extending flange having screw holes 26*bb* therein and is used in mounting the display device 10 directly on the wall by means of screws (not shown) received in screw holes 26*bb*, while mounting part 26*c* includes an outwardly (e.g., upwardly) extending flange having an opening 26*cc* therein through which a chain, cord or the like (not shown) can be passed to enable suspension of display device 10 from a suitable support (not shown). Screws 46 are used to secure mounting parts 26*b* or 26*c* to base part 26*a*. The exemplary embodiment of FIG. 1 employs a mounting part corresponding to 26*b*.

Central frame member 30 also includes an upright post 48, with lateral flanges 48*a*, 48*b*, which extends upwardly into central frame opening 31. These flanges 48*a*, 48*b* together with an upwardly extending base flange 50 and laterally inwardly extending side flanges 52 (one of which is shown in FIG. 4) form stop surfaces against which backlight assembly sandwich 34 abuts and is held. As is best seen in FIG. 4, inwardly extending ridges or projections 54 located on the inside surfaces of the side walls of frame member 30 and an inwardly extending ridge 55 which projects downwardly from the upper wall of frame member 30 are used in securing rear frame member 32 in place as explained below, and shaped notches 56 (see FIG. 4) formed in the lower rear edges of the side walls of frame member 30 enable controlled pivoting of cover frame member (beauty shell) 28 as is also explained below.

As shown in FIG. 2 and to some extent in FIG. 3, the back-lighting sandwich or module 34 held in place between central frame member 30 and rear frame member 32 comprises a light guiding "microreplification" reflector 58, a circuit board 60 which is preferably made of translucent or clear flexible plastic and which carries or supports a plurality of light sources or lamps 61 thereon, and a cover sheet 62 which is preferably made of clear or smokey white plastic. The reflector 58 includes a plurality of formed cavities or recesses, generally denoted 64, therein which correspond in number to the number of numerals 22 (there are four in this example) and which are generally the shape of a digital, i.e., squared off, "eight" due to the presence of a central bar 64*a* which divides the corresponding recess into two recesses 64*b*, 64*c*. The openings 64*a*, 64*b* each include a series of angled steps 64*aa* and 64*bb* which provide proper focussing of the light from light sources 61. As illustrated in FIG. 3, light sources or lamps 61 are arranged in pairs with the light source or lamps 61 of each pair being individually disposed centrally within upper and lower openings 64*b* and 64*c*.

As shown in FIGS. 2 and 3, reflector 58 includes further vertically spaced recesses 66 and 68, and recess 66 contains vertically spaced screw receptacles 70 which receive screws 72 for securing circuit board 60 in place.

Circuit board 60 further includes three additional lamps or light sources 74 which provide lighting up of display window 22 (FIG. 1) containing letters 24. Circuit board 60 also carries conventional circuitry for the lamps 61 and 74 and is connected through screws 72, which serve as terminal screws, to cable 14.

Sheet 62 includes a raised portion 62*a* which registers with upper recess 66 of reflector 58 to provide space for circuitry described hereinbelow.

The back-lighting assembly sandwich or module 34 slides into the back of central frame member 30 behind projecting portions 44, 54 and 55 and is held in place by rear frame member 32. The latter is of open rectangular shape and includes small arcuate portions 32*a* in the side walls thereof which fit around screw cups or receptacles 44 of central frame member 30. Rear frame member 32 snaps in place behind ridges 54 (FIG. 4) on the inside surfaces of the side walls of central frame member 30 and is held in place by a screw 76 which is screwed into a screw hole 78 (FIG. 4) in central frame member 30, and which extends through corresponding (unnumbered) holes in the rear cover 32, reflector 58, and cover sheet 60. (Circuit board 60 is received in a shallowly recessed portion of reflector 58 and thus screw 76 passes through reflector 58 below circuit board 60.)

In the preferred embodiment, the alphanumeric display sandwich 36 comprises a clear or translucent colored sheet 80, a translucent white sheet 82 treated to resist ultraviolet rays and weather, a character sheet 84 which contains the numerals 20 and letters 24 discussed above, a first cover sheet 86 including framing borders 86*a* and 86*b* for the numbers 20 and letters 24, respectively, and a clear or tinted, ultraviolet resistant, or filtering plastic protective face shield 88. The character sheet 84 can be fabricated of vinyl or a like material and cut out using computer controlled sign making equipment employed for producing customized alphanumeric displays. Alternatively, custom printed and treated weather resistant materials, stencils, sheets, films and the like can be used to produce the characters to be displayed. The character sheet 84 may be perforated so that individual segments can be punched out by a user to display the desired numerals, letters, and the like.

The cover frame member or "beauty shell" 28 is shown in FIGS. 2 and 3, and as noted above (and as is indicated in FIG. 3), pivots to an open position relative to the remainder of the display to permit alphanumeric display sandwich 36 to be loaded into the display unit. Screws 90 extending through holes 92 in the side walls of cover frame 28 and received in holes 94 in central frame member 30 provide this pivoting. Because of the shape of notch 56 in the lower rear edge of central frame member 30 (see FIG. 4) cover frame member 28 can be swung open 90° and retained in position as shown in FIG. 3 to permit the aforementioned loading of display sandwich 36, and then swung back to a closed position. Windows 18 and 22 mentioned above in connection with the discussion of FIG. 1 are formed in cover frame member 28 and enable viewing of the numerals 20 and letters 24 of character sheet 84. A shown in FIG. 2, a recess 96 formed in cover member 28 permits display of further information such as the manufacturer's name carried on a product label or name sheet 98 which is secured in recess 96, e.g, by self-adhesion. A photocell lens 100 extends through a hole 98*a* in label or sheet 98 and snaps into place in an aperture 102 in cover member 28 so as to direct light to a photocell switch 119 (See FIG. 2) for controlling lighting up of lamps 61 and 74.

Figure 5:
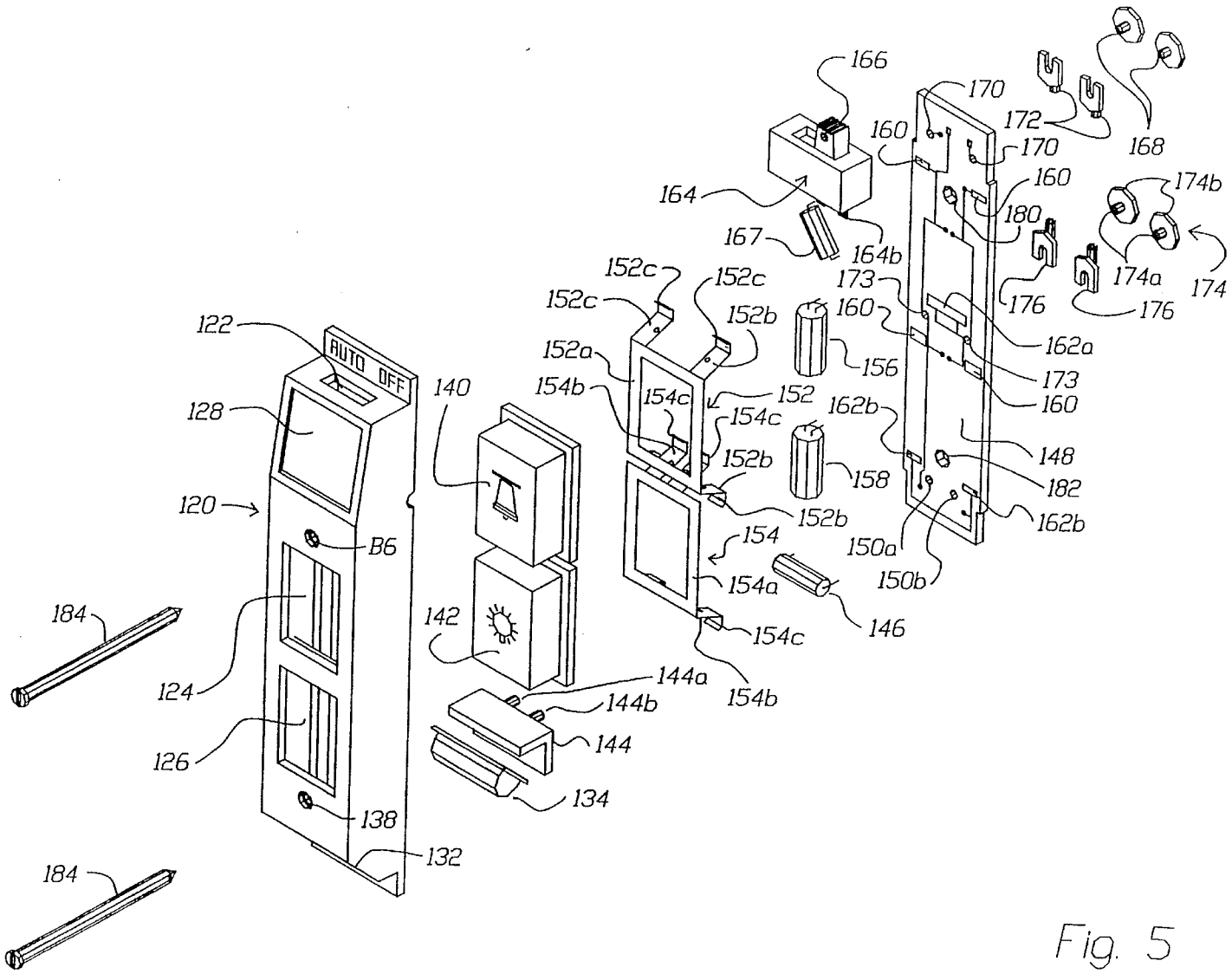
FIG. 5 is an exploded top front perspective view of the doorbell control assembly of FIG. 1.
Figure 6:
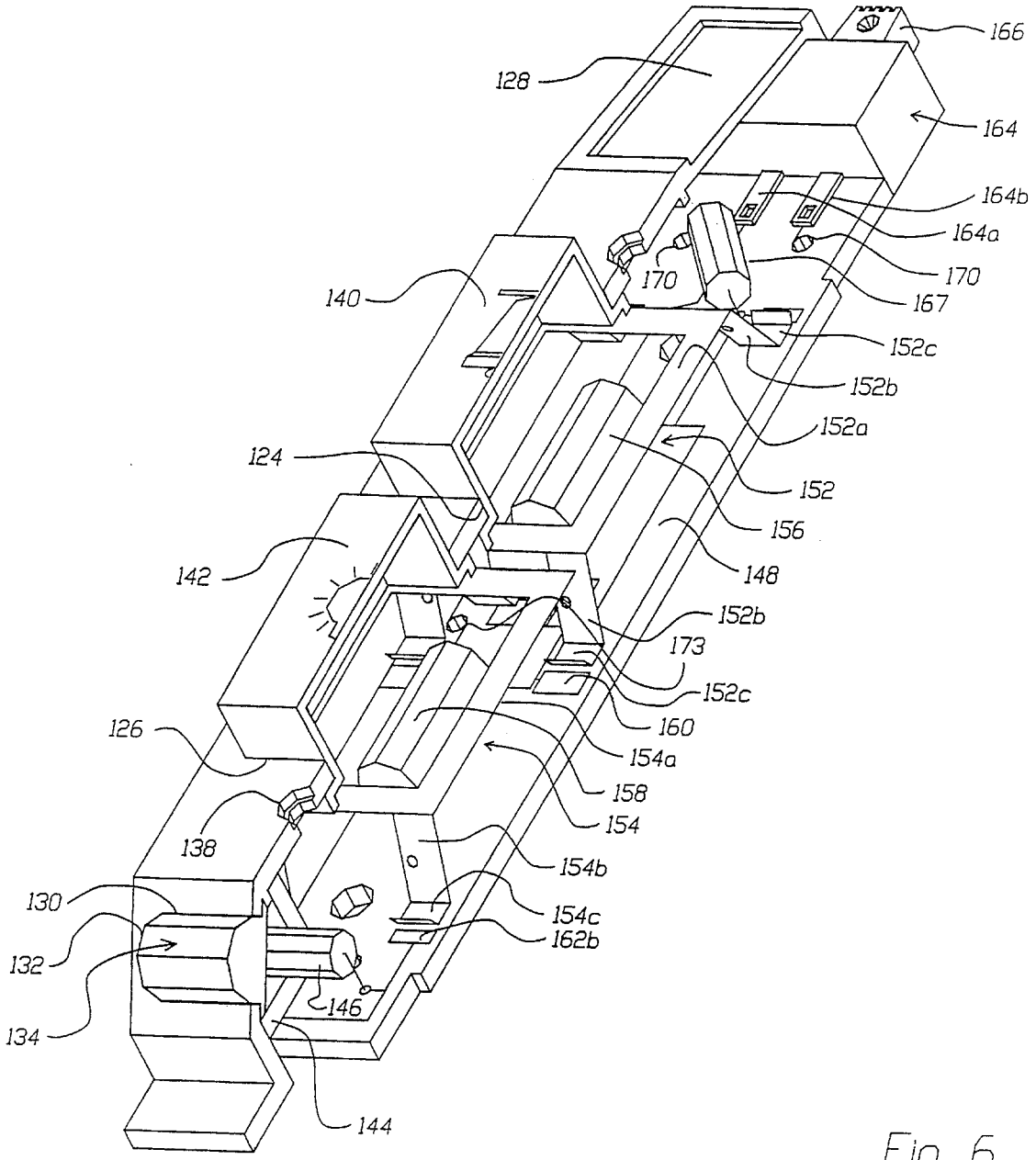
FIG. 6 is a cutaway bottom perspective view of the doorbell control assembly of FIGS. 1 and 5.

Turning now to the doorbell assembly 12 of FIG. 1, and referring to FIGS. 5 and 6, the assembly 12 includes an external housing 120 having an opening 122 (FIG. 5) in the upper top surface thereof and a pair of vertically spaced openings or windows 124 and 126 in the front face thereof. A slightly inclined panel or portion 128 disposed above opening 124 is provided for identification of the name of the manufacture or can be blank as shown. A further opening 130 (FIG. 6) is provided in an inwardly inclined portion 132 of housing 120 located near the bottom of housing 120 and is adapted to receive a light focusing lens 134 therein. Screw holes 136 and 138 are provided above window 124 and below window 126.

A first, doorbell actuating pushbutton 140 is received in opening 124 while a second, light control pushbutton 142 is received in opening 126. A right angle reflector 144 is disposed behind lens 134 with a light bulb or lamp 146 being positioned between reflector 144 and lens 134. This arrangement results in the light from lamp 146 being directed through lens 134 below assembly 12 at an angle so that the light can be used to identify a door key, check an address contained on a slip of paper or perform another task requiring light. Lamp bulb 146 is connected to a printed circuit board 148 that forms the back wall of assembly 12. Reflector 144 includes rearwardly extending mounting prongs or projections 144*a* and 144*b* which are received in horizontally spaced openings 150*a* and 150*b* in circuit board 148 so as to mount reflector 144 between external housing or cover 120 and the circuit board 148.

A pair of resilient contacts 152 and 154 are disposed behind actuators 140 and 142, respectively, between actuators 140, 142 and circuit board 148. A pair of lamps or light bulbs 156 and 158 are secured to circuit board 148 behind actuators 140 and 142, respectively. Contacts 152 and 154 include open rectangular portions 152*a* and 154*a* which are engaged by actuators 144 and 142, respectively, and are open centrally so as to permit light from lamps 156 and 158 to pass therethrough and thus illuminate pushbuttons 140 and 142. Contacts 152 and 154 further respectively comprise four support legs respectively denoted 152*b* and 154*b*, disposed at the four corners of rectangular portion 152*a* and at the middle of the top and at the two lower corners of rectangular portion 154*a*, respectively, and extending outwardly (rearwardly) therefrom. The legs 152*a* and 152*b* includes contact feet 152*c* and 154*c*, respectively, at the bottoms thereof which, when the pushbuttons 140 and 142 are actuated, cooperate with contact pads or terminals 160 and 162, respectively, to complete the circuits for lamps 156 and 158. More particularly, considering pushbutton 142 as typical, depression of pushbutton 142 will cause legs 154*b* of contact member 154 to splay out in the front and rear so that contact feet 154*b* will make contact with corresponding terminals 162 of circuit board 128, viz., with an upper common contact 162*a* and lower spaced contacts 162*b*.

A switch unit 164 including a sliding actuator 166 and an associated fuse 167 is mounted at the top of housing 120 such that switch actuator 166 extends through opening 122 in housing 120. As indicated, actuator 166 has, but is not limited to, two operative positions, viz., an "auto" position and an "off" position and switch unit 164 includes a pair of contacts 164*a* and 164*b* (FIG. 6) which provide connections with the circuitry of circuit board 148. In particular, switch unit 164 controls completion of circuit connection to display assembly 10 for turning on and off the power of that assembly, and contact 164*a* and 164*b* are connected to terminal buttons or posts 168 received in openings 170 in circuit board 148 and adapted to be contacted by spade contacts 172 connected to unit 12 through electrical cable 14 of FIG. 1.

A further pair of openings 173 in circuit board 148 receive respective contact posts 174*a* of a pair of contacts 174 (FIGS. 1 and 3) and a further pair of spade contacts 176 connected to electrical cables or wires 178 (FIG. 1) are adapted to be connected between the flat headed portions 174*b* of contacts 174 and the back of circuit board 148. Wires 178 are conventional existing electrical outlet wires used in providing connections to a conventional doorbell unit DU.

Circuit board 148 also includes vertically spaced openings 180 and 182 therein which register with openings 136 and 138 of housing 120, and a pair of long screws 184, which are adapted to extend through the aligned openings 136, 180 and 138, 182, respectively, are used to secure unit or assembly 12 to the wall, i.e., to mount the unit 12 on the wall of a building or residence.

Figure 7:
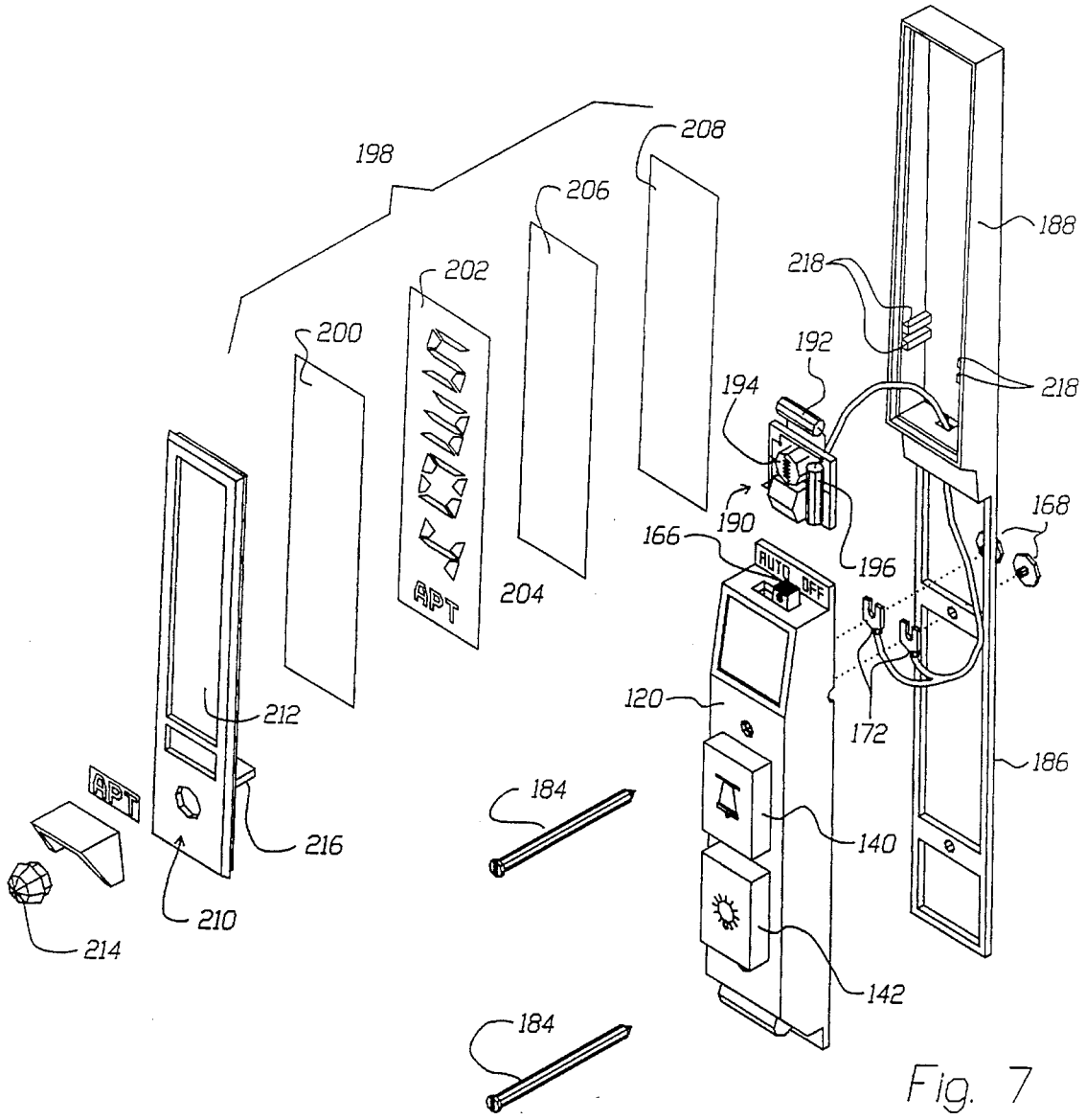
FIG. 7 is a partially exploded perspective view of a combination address display and doorbell control assembly constructed in accordance with a further embodiment of the invention.

Referring to FIG. 7, a further embodiment of the invention is shown which is similar to that of FIG. 2 but which provides a different implementation of the display unit. This embodiment employs a doorbell unit similar to unit 12 of FIG. 1 and like elements of the doorbell unit of FIG. 7 have been given the same reference numerals with primes attached. Unit 12' is mounted on a lower mounting bracket 186 which is formed integrally with an upper housing 188 containing lighting control circuitry indicated at 190, including a light source (lamp or bulb) 192, a photocell switch 194 and a resistor 196 (a portion of which can be seen), and a display sandwich 198 comprising, in the exemplary embodiment illustrated, a clear sheet 200, a vinyl sheet 202 including numerals 204, a translucent sheet 206 and a colored or tinted sheet 208. A cover 210 includes an opening or window 212 through which numerals 204 can be viewed and a lens 214 which directs light to the photocell switch 194 for controlling lighting up of light source 192. Cover 210 further includes a rearwardly extending tongue or flange 216 which is received in the guide slots defined between pairs of guide rails 218 formed on both inner side walls of housing 188. Further guide rails 220 form slots which receive display sandwich 198 when the latter is assembled. A recess 222 receives a sticker 224 carrying the abbreviation "APT" or like residence identification.

It will be appreciated that the embodiment of FIG. 7 is simpler and less expensive to manufacture than that of FIG. 1 and may be preferable by users that live, for example, in an apartment.

It will be understood that the doorbell control assembly described above is not limited to the specific implementation discussed, particularly with respect to the electrical circuitry employed. For example, an additional switch can be provided to control completion of electrical circuit via wires 220 to an emergency flasher unit (EFU) such as might be used by a homeowner to indicate an emergency situation. Similarly, circuitry can be provided to produce flashing of address display 10. In addition, a timer circuit (not shown) can be provided for, when actuated, energizing lamp 146 for a predetermined period of time (e.g., 30 seconds) after which period lamp 146 would be de-energized. Because traditional door bell wiring provides an average of 16 volts at 10 watts of potential power to the doorbell unit DU, a further backup power source with circuitry which is continuously trickle charged via the doorbell unit DU can be provided to enhance, e.g., the power available for continuously illuminating the Address display without power surges during usage of the doorbell while address display is on, to prevent interruption of per flow to the doorbell. The above-mentioned circuit is installed into external device such as address display, flasher, or the like rather than in doorbell.

Figure 8:
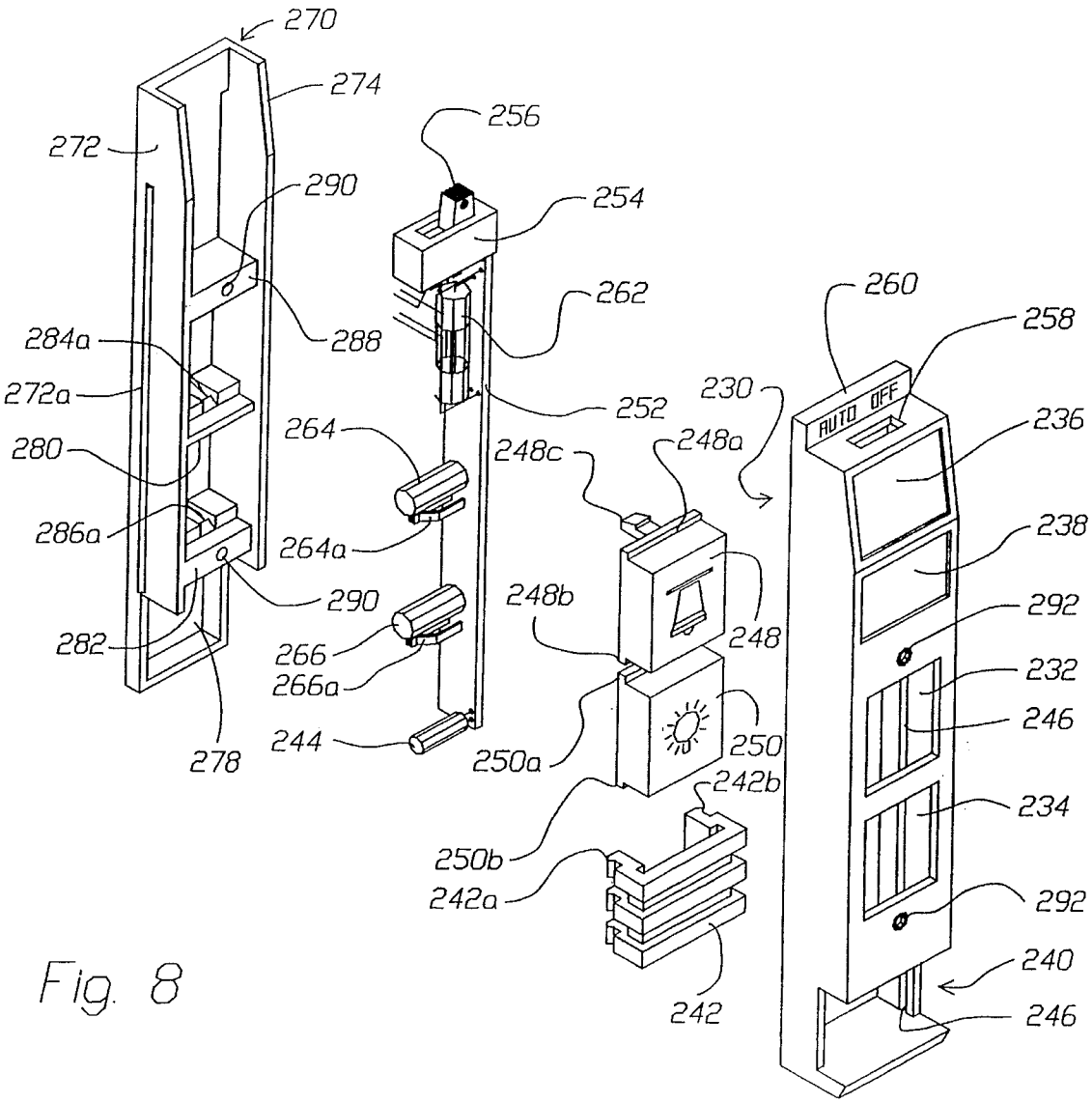
FIG. 8 is a front exploded perspective view of a further embodiment of the doorbell control assembly.
Figure 9:
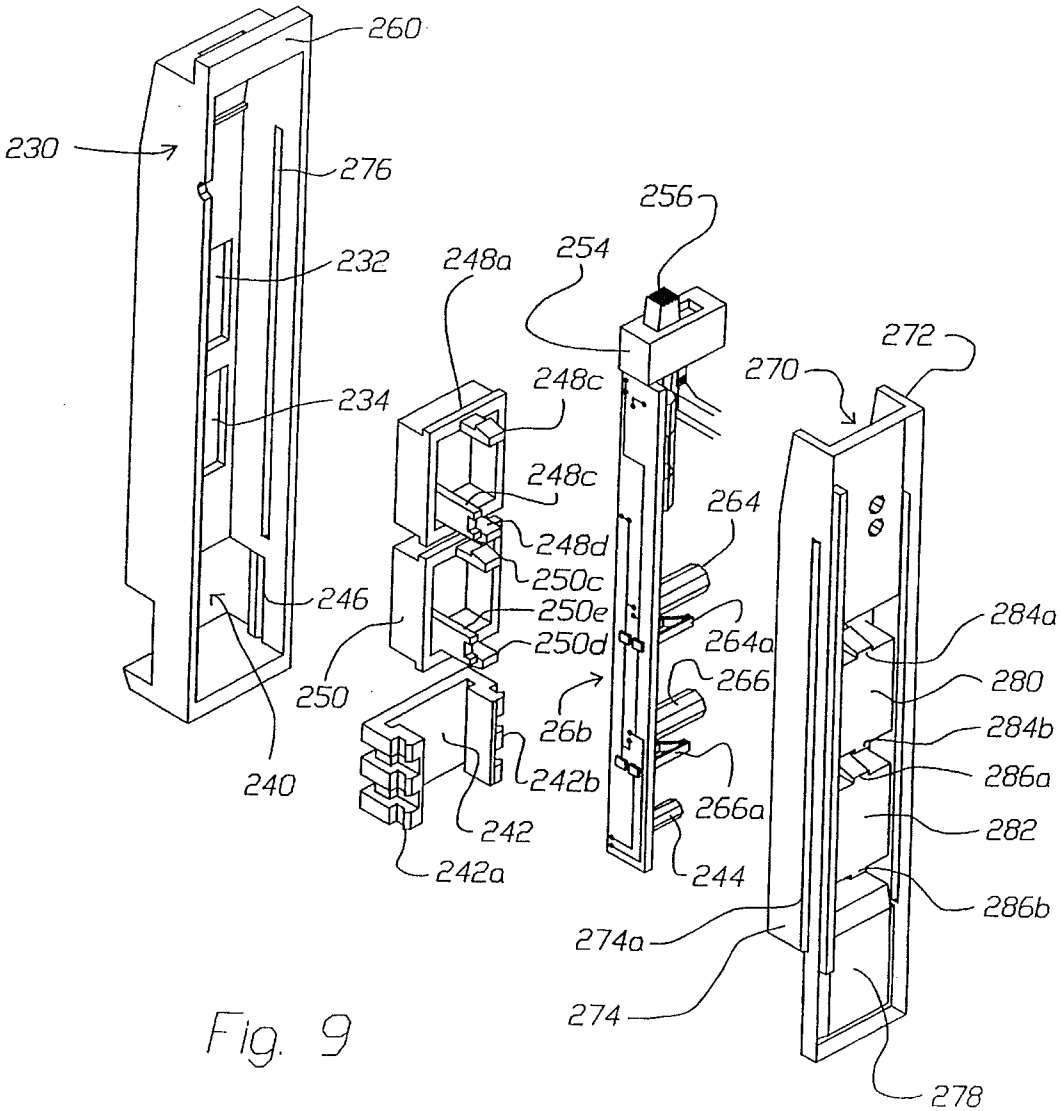
FIG. 9 is a rear exploded perspective view of the assembly of FIG. 8.

Referring to FIGS. 8 and 9, there is shown a further embodiment of the door control assembly of the invention. The assembly includes an external or front housing member 230 having vertically spaced openings 232 and 234 therein. Shallow recesses 236 and 238 in the upper portion of housing member 230 are adapted to receive adhesive labels (not shown) which can contain logos, lettering, symbols and the like. A lower opening 240 receives a generally U-shaped lens 242 for a lamp bulb 244 or other light source. Lens 242 includes, formed on the legs thereof, a pair of locking ridges 242*a* and 242*b* which engage in corresponding female locking grooves formed in the side walls of housing member 230 and only one of which, denoted 246, can be seen in FIGS. 8 and 9.

Openings 232 and 234 receive a doorbell control pushbutton or actuator 248 and a light control pushbutton or actuator 250, respectively. As illustrated, pushbutton 248 contains suitable "bell" graphics and pushbutton 250 includes suitable "light" graphics. Pushbutton 248 includes upper and lower limit flanges 248*a* and 248*b* which retain pushbutton 248 within opening 232, upper and lower rearwardly projecting locking members 248*c* and 248*d* and a rearwardly projecting contact guide and actuator member 248*e* (see FIG. 9). Pushbutton 250 likewise includes a similar pair of flanges 250*a* and 250*b*, similar locking members 250*c* and 250*d* and a similar contact guide and actuator member 250*e*.

A circuit board 252 carries a switch unit 254 having switch actuator 256 adapted to project upwardly through an opening 258 in the top wall of housing member 230. The switch actuator 256 has "AUTO" and "OFF" positions which are indicated on a raised portion or upright flange 260 at the top of housing member 230. Also mounted on circuit board 252 are a fuse 262, a pair of lamps or light bulbs 264 and 266, with associated contact pairs 264*a* and 266*a*, respectively, and a lamp or light bulb 244, together with the connecting circuitry or wiring indicated at 268 in FIG. 9.

A backing member 270 includes forwardly projecting side walls 272 and 274 having laterally projecting locking rails 272*a* and 274*a* formed thereon. Rails 272*a* and 274*a* engage in corresponding grooves which are formed in the internal surfaces of the side walls of housing member 230, and one of which, denoted 276, is shown in FIG. 9, so that a snap fit between housing member 230 and backing member 270 is provided.

Backing member 270 also includes a reflector 278, disposed behind lamp 244, for providing reflection of the light produced by lamp 244.

Horizontally extending connecting portions 280 and 282 interconnect side walls 272 and 274 and have pairs of forwardly facing wedge shaped recesses 284*a* and 284*b* and 286*a*, 286*b* formed therein in the upper and lower surfaces thereof. Recesses 284*a*, 284*b* and 286*a*, 286*b* cooperate with rearwardly projecting locking members 248*c*, 248*d* and 250*c*, 250*d* so as to provide releasible locking of pushbuttons 248 and 250 in the depressed states thereof and to enable release of pushbuttons 248 and 250 from the depressed states thereof in response to further depression of the pushbuttons through the spring-like action provided. More particularly, considering pushbutton 258 as typical, when further depressed and released pushbutton 258 is pushed back to the unactuated or rest state thereof by the spring-type force produced by the interaction of the corresponding projections 248*c*, 248*d* and wedge-shaped recesses 284*a*, 284*b*.

Horizontal connecting portion 282 also includes a screw hole 290 therein as does a further horizontal portion 288. Screw holes 290 align with vertically spaced screw holes 292 in housing 230 and receive long screws (not shown). These screws also help connect housing member 230 and backing member 270 together, with the circuit board 252 and pushbuttons 248 and 250 therebetween, and extend into the mounting surface or wall on which the unit is mounted. The circuit board 252 is received in the space between housing 230 and backing member 270 and contact guide and actuator members 248*e* and 250*b* engage contact pairs 264*a* and 266*a* to bring the contact pairs into contact with each other and thus complete the electrical circuits for lamps 248 and 250 when the corresponding pushbuttons 248 and 250 are depressed.

It will be appreciated that the embodiment of FIGS. 8 and 9 is simplified in construction and easier to manufacture than previously described embodiments but the overall operation thereof is substantially the same as the embodiments described above and will note be described further.

Figure 10:
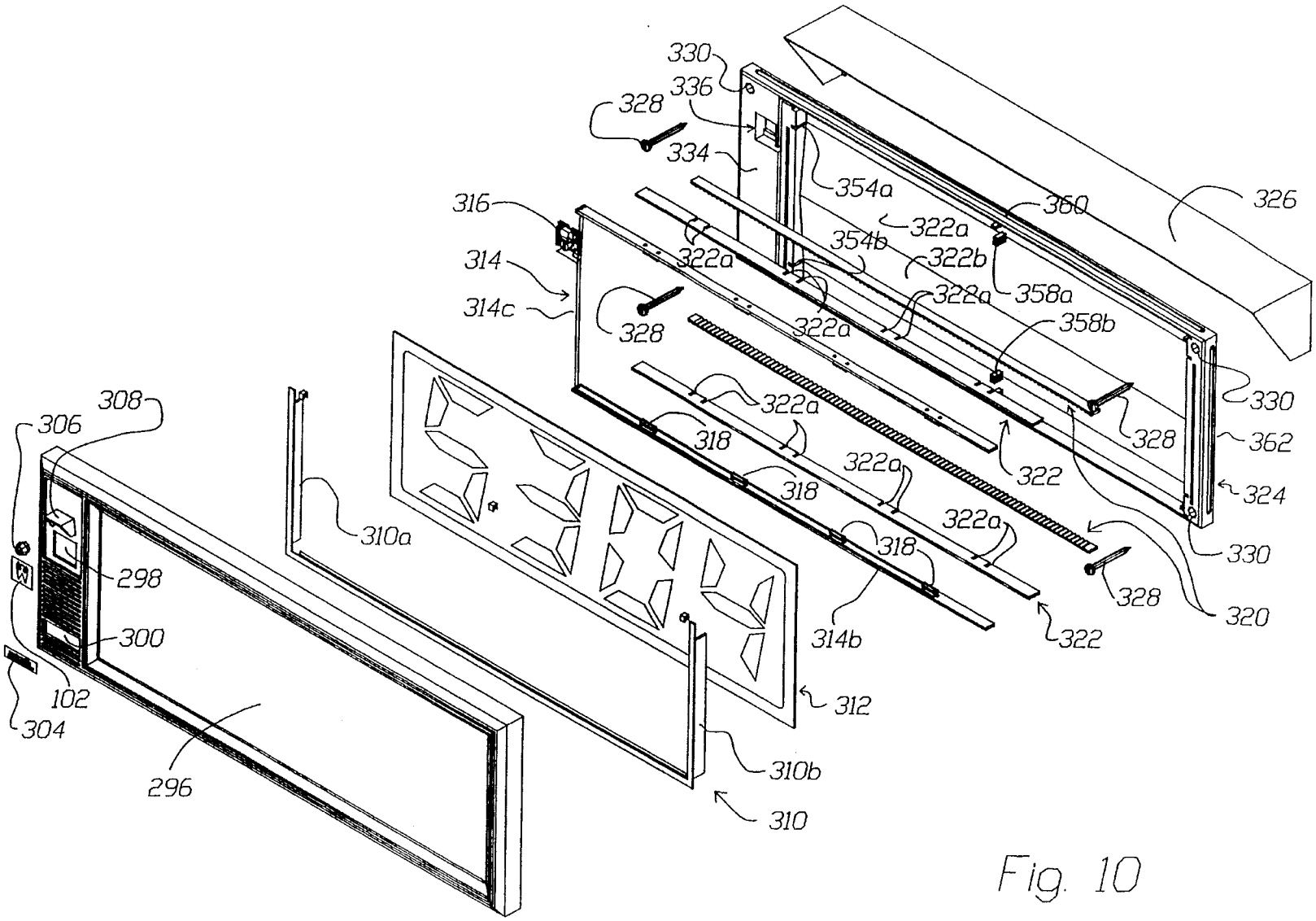
FIG. 10 is a front exploded perspective view of a further embodiment of the display device of the invention.

Referring to FIG. 10, there is shown a further embodiment of the address display unit or device of the invention. The device is similar to the corresponding display unit of FIG. 1 and includes an outer rectangular cover member or body 294 having a large opening 296 therein for viewing an alphanumeric display 312 and a pair of small recesses 298 and 300 therein for labels 302 and 304, respectively. A photocell lens 306 is also mounted on cover member 294 and is shielded by a small shield or scoop 308.

An intermediate frame member 310 is also of rectangular shape and includes rearwardly extending lateral projections 310*a* and 310*b*.

The alphanumeric display member 312 includes, in this instance, a plurality of numbers representing the street address of the corresponding residence.

A circuit board or component carrier frame 314, which is of a generally U-shaped configuration, includes the device electronics (a photocell and associated switching circuitry) which are generally denoted 316 and a plurality of lamps or light bulbs 318 located in spaced relation along the upper and lower legs 314*a* and 314*b* of circuit board 314.

In a first embodiment, a pair of reflector strips 320 are provided which are of a translucent or clear Fresnel type for scattering the light to the rear of the unit. In an alternative embodiment, a pair of opaque light reflector strips 322 are used which include slots 322*a* used in mounting the strips 322 in place as explained below.

A rear housing member 324 mates with, and snap fits into, cover member 294 so that the intermediate components are captured and held in place therebetween, while a shield member or scoop 326 of generally U-shaped configuration blocks light radiated upwardly at the top of the unit. Four screws 328, which extend through openings 330 at the corners of rear housing member 324, serve to affix rear housing member 324 to the support surface (e.g., a wall) to which the unit is to be affixed.

Figure 11:
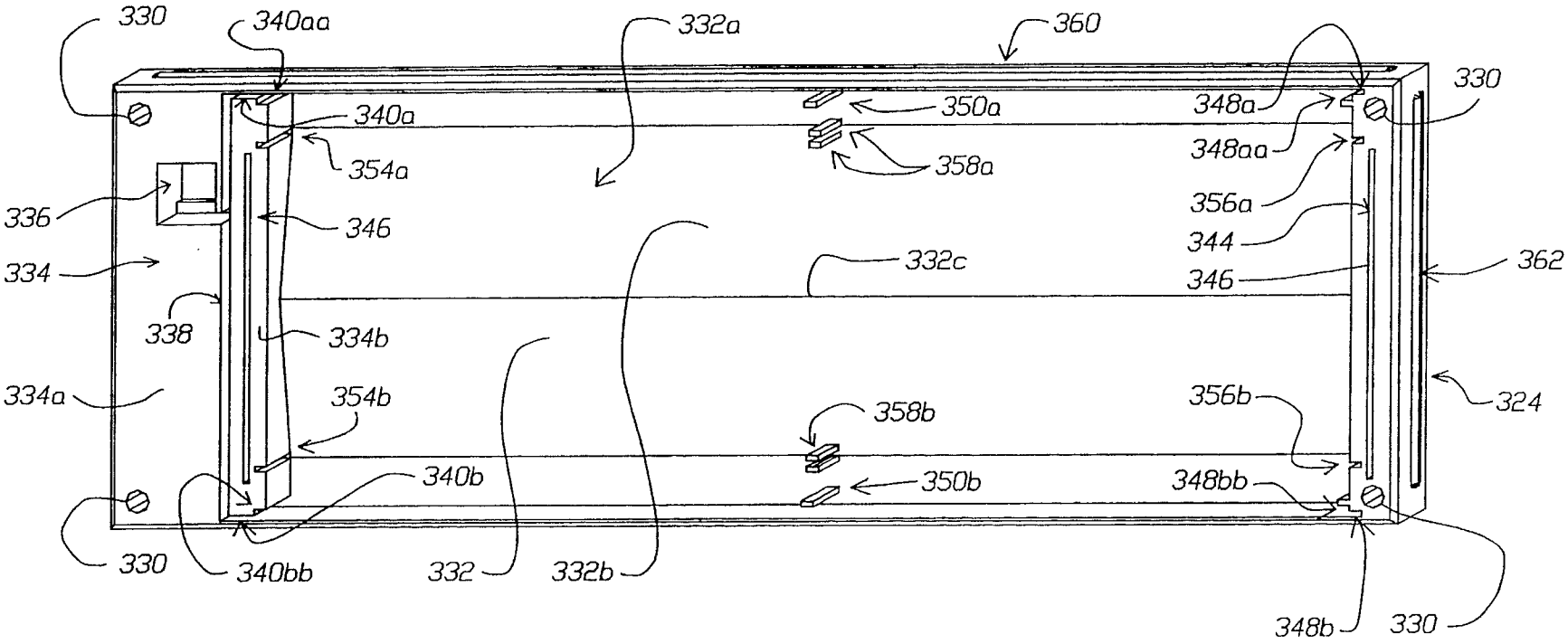
FIG. 11 is a perspective view, drawn to an enlarged scale, of the rear frame member or backing member of FIG. 10.

Rear housing member 324 can best be seen in FIG. 11 and as shown, comprises a back wall 332 formed by angled, flat reflector panels 332*a* and 332*b* which converge to a common peak 332*c* along the center of back wall 322. A thickened housing portion 334 at one side of rear housing member 324 includes a chamber 336 formed therein in which the device electronics 316 are received. A slot or trench 338 receives the upright connection portion 314*c* of U-shaped circuit board or component carrier 314 while corresponding slots 340*a* and 340*b* at the top and bottom of housing portion 334 accommodate the proximal portions of legs 314*a* and 314*c*.

Slot 338 separates housing portion 334 into a main portion 334*a* in which chamber 326 is formed and a pillar or frame portion 334*b* including a vertical slot 342 therein. A similar pillar or frame portion 344 is formed at the opposite side of backing member 324 and includes a corresponding slot 346. Slots 342 and 346 are adapted to receive the rearwardly extending mounting projections or support rails 310*a* and 310*b* of intermediate frame member 310. Frame portion 344 also includes upper and lower slots 348*a* and 348*b* which receive the distal ends of the legs 314*a* and 314*b* of circuit board or component carrier 314.

In the embodiment of the invention which uses opaque reflector strips 322, slots 340*a* and 340*b* are provided with enlarged end portions or steps 340*aa* and 340*bb* and slots 248*a* and 248*b* are provided with similar steps 248*aa* and 348*bb* which receive and support the opposite ends of each of the strips 322. Separate, centrally located support or restraining posts 350*a* and 350*b* are also provided. The pairs of slots 322*a* in the strips 322 fit around the pairs of wires which support lamps or light sources (lights) 318 on the legs 314*a* and 314*b* of carrier 314 and thus lights 318 extend beyond strips 322 into the interior of rear housing member 324 in this embodiment.

In the alternative embodiment using the translucent or clear Fresnel type reflector strips 320, rear housing member 324 is provided with upper and lower pairs of slots 354*a*, 354*b* and 356*a* and 356*b* in the inside opposed surfaces of lateral pillar or frame portions 334*b* and 344, which receive the opposite ends of the two strips 320. Further, centrally located upper and lower pairs of support or retaining posts 358*a* and 358*b* support the strips 320 at the centers thereof. With the unit assembled, strips 320 are thus spaced from lights 318 and thereby provide scattering of the light therefrom.

Locking rails or ridges are provided on all of the side surfaces of rear housing member 334 and two of these, which are denoted 360 and 362 and are located on the top edge and right side edge surfaces as viewed in FIG. 11, can be seen in the drawings. These locking rails or ridges are received in corresponding slots (not shown) in inwardly facing surfaces of rearwardly extending framing walls of cover member 294 so that cover member 294 can be snap fit on rear housing member 334. Thus, the entire unit can be readily assembled in a highly efficient manner.

Figure 12:
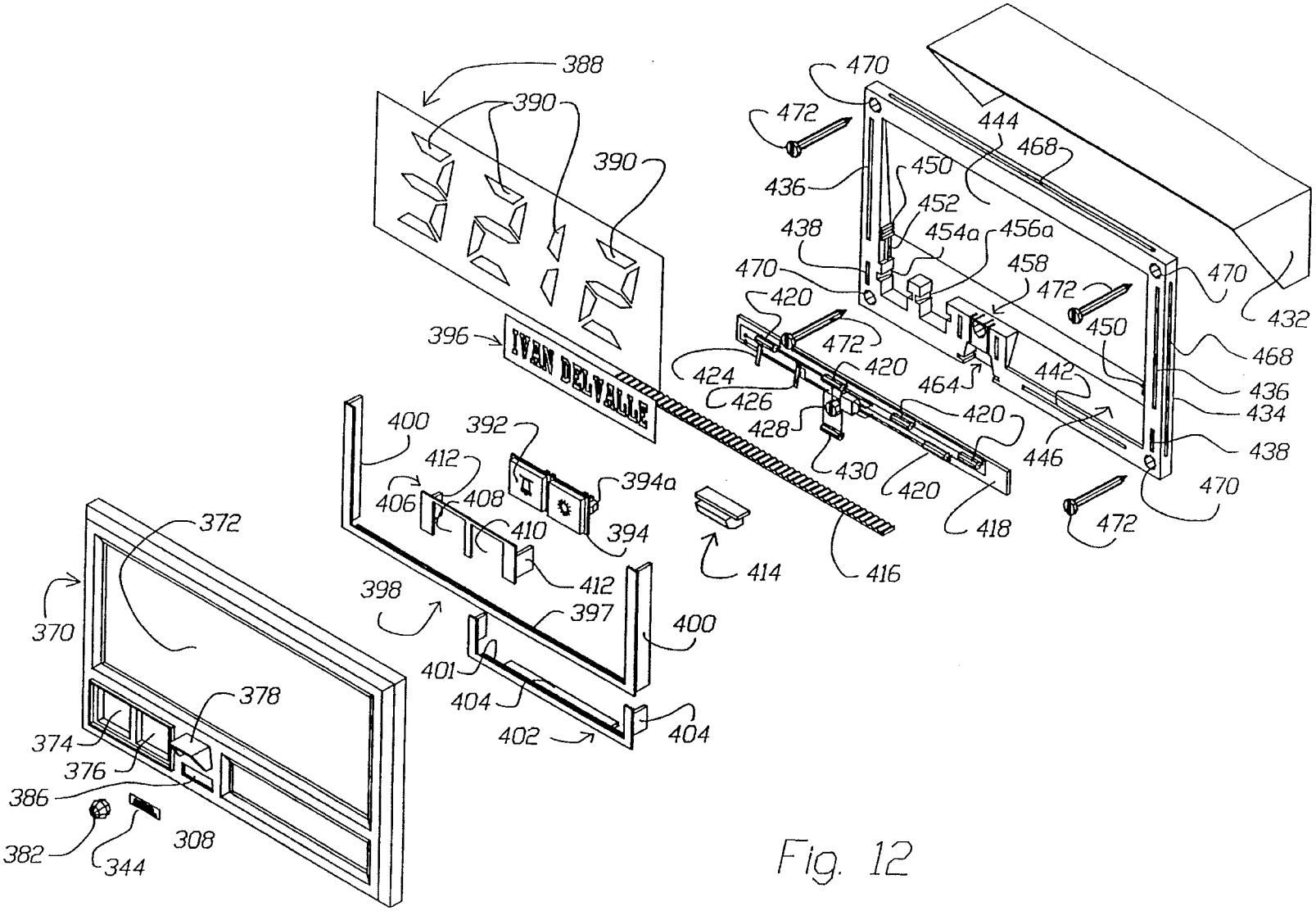
FIG. 12 is a front exploded perspective view of a further embodiment of the combination address display and doorbell control assembly.
Figure 13:
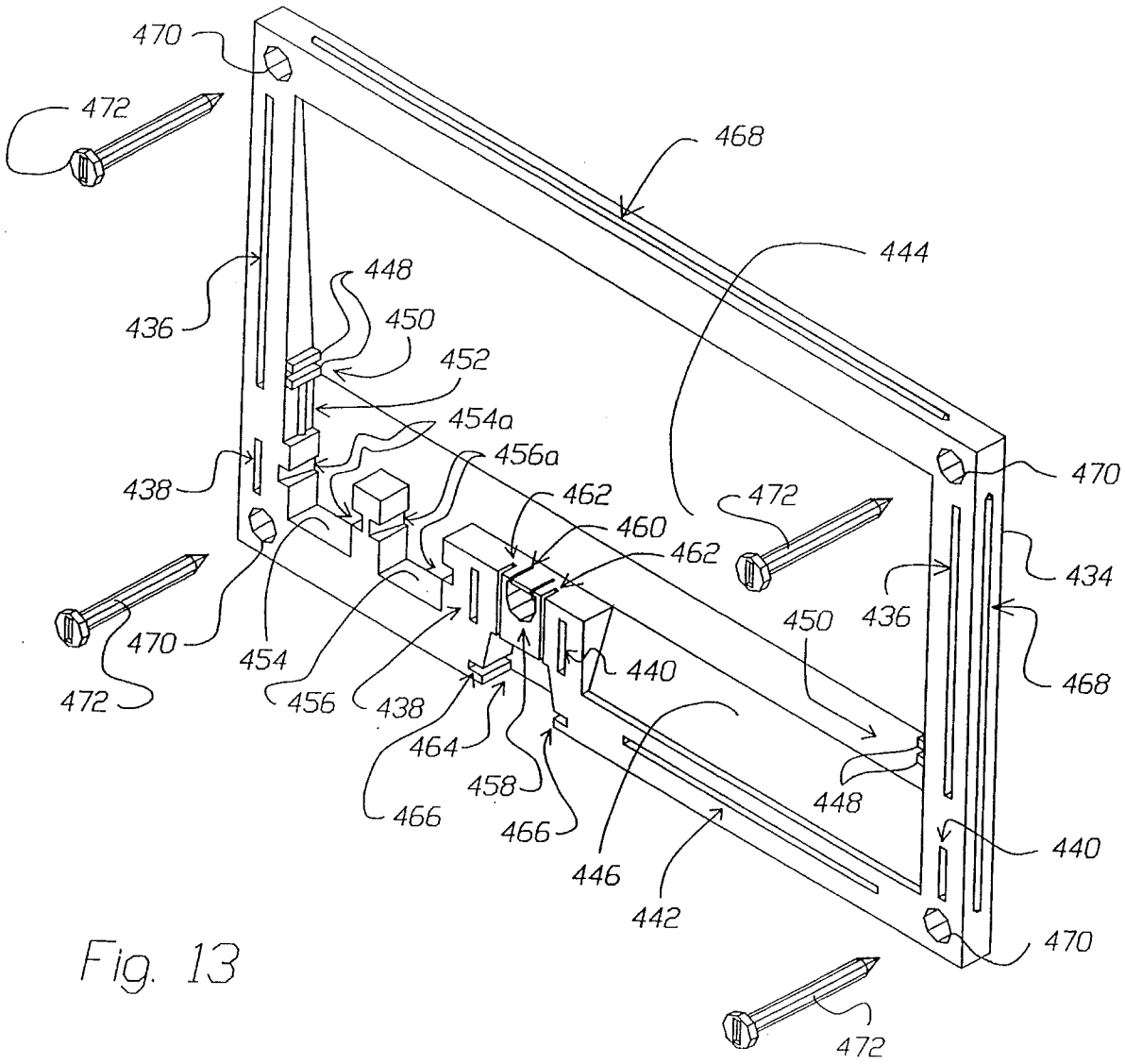
FIG. 13 is a perspective view, drawn to an enlarged scale, of the rear frame member or backing member of FIG. 12.

Referring to FIGS. 12 and 13, there is shown a further embodiment of the combined control device and display. This embodiment combines features of the embodiments of FIGS. 9 and 10 and FIGS. 10 and 11 and includes an outer frame member or beauty shell 370 having a large upper opening 372 therein and a pair of lower openings 374 and 376 on one side of a shield or scoop 378 and further elongate opening 380. A photocell lens 382 is disposed below shield 378 and a label 384 is received in a recess 386. The large opening 372 permits viewing the contents of an alphanumeric display member 388 containing numerals 390, while the openings 374 and 376 at the lower left side (as viewed in FIG. 12) receive door bell actuator 392 and light actuator 394, respectively. Opening 380 permits viewing of a further alphanumeric display member 396 which, as indicated, may contain the name of the resident of the dwelling with which the unit or assembly is used.

Alphanumeric display member 388 is received in a lower slot 397 in a U-shaped intermediate frame member 398 including rearwardly extending locking rails or flanges 400 while alphanumeric display member 396 is similarly received in a lower slot 401 in a U-shaped intermediate frame member 402 including rearwardly extending locking rails or flanges 404. Similarly, actuators 392 and 394 are received in an actuator locking frame 406 having front openings 408 and 410 through which actuators 392 and 394 extend as well as a pair of rearwardly extending locking rails 412.

The assembly further includes an external clear light projecting lens 414 which is similar to lens 242 of FIGS. 8 and 9, and a clear Fresnel lens strip 416 which is also similar to those described above. A circuit board 418 carries a series of lights or lamps (light sources) 420 and 422 which are connected as shown and which serve to illuminate alphanumeric display member 388 (in the case of lights 420) and alphanumeric display member 396 (light 422). Circuit board 418 also carries switch contact pairs 424 and 426 which are actuated by depressing of actuators 392 and 394, respectively, in a manner similar to that described above in connection with FIGS. 8 and 9. Also mounted on circuit board 418 are a photocell 428 which supplies light through lens 382 and a further light or lamp (light source) 430 which supplies light through light projecting lens 414.

A shield or scoop 432, similar to that described above, is mounted on the unit in suitable manner, preferably by means of a snap fit with a rear frame member or backing member 434 which is best seen in FIG. 13.

Referring particularly to FIG. 13, backing member 434, which is similar to those described above, includes an upper pair of lateral slots 436 that receive locking flanges 400 of intermediate frame member 398, a first pair of lower lateral slots 438 that receive rearwardly extending male projections or flanges 412 of actuator locking member 406, and a second pair of lower lateral slots 440 and a transverse slot 442 for receiving rearwardly extending flanges 404 of intermediate frame member 402.

Backing member 434 further includes an upper reflector panel 444 which positioned behind display member 388 and a lower reflector panel 446 which is positioned behind display member 396. Opposed pairs of projections 448 form opposed slots 450 in which the ends of Fresnel lens strip 416 are received while vertical ridges or rails 452 (one of which can be seen in FIG. 13) serve in securing circuit board 418 in place.

Lower side-by-side openings 454 and 456 receive actuator members 392 and 394, respectively, and include slanted grooves 454*a* and 456*a* in the opposed sidewalls thereof which are similar to the corresponding grooves described above in connection with FIGS. 8 and 9 and serve a similar function, i.e., to receive rearwardly projecting locking members of actuators 392 and 394, one of which, denoted 394*a*, can be seen in FIG. 12.

A central lower portion of backing member 434 includes an opening 458 in which photocell 428 is received and a pair of slots 460 for the associated connecting wires for the photocell 428. Further slots 462 on opposite sides of slots 460 receive the connecting wires for light source 430 while a lower opening or recess 464 receives the light source 430 itself. Lower opposed horizontal slots 466 receive opposite ends of the support portion of lens 414.

The upper and lower and lateral edges of backing member 434 include locking ridges, two of which, denoted 468, are shown in FIGS. 12 and 13, that cooperate with corresponding grooves (not shown) formed in rearwardly extending flange portions of cover member 370 to provide a snap-on fit.

Holes or apertures 470 at the corners of backing member 434 receive screws 472 so as to enable mounting of backing member 434 on a wall or other support surface.

Considering some further additions, or alternatives, to the constructions described above, all of the actuators (e.g., those corresponding to actuators 392 and 394) of the doorbell powered units or of the optionally powered units can be made to light up at night to facilitate their use. Further, adhesive attachments (in place of, e.g., screws 472) can be used with some units depending on the intended application, and the circuit boards (e.g., circuit board 418) can be provided with bulbs on one side or both sides, depending on the layout of the corresponding unit, to provide illumination of the external lens or one or more alphanumeric displays of a single unit.

It is noted that a number of different techniques or formats can be used which permit a user to produce the alphanumeric display that he or she desires (e.g., representing his or her house number) from an alphanumeric display kit. For example, the display can be formed by molded segments made from rubber, plastic or the like which are inserted into correspondingly shaped openings forming a seven segment display so that by removing selected segments, any digit can be formed. Further, the segments can be replaced and/or other segments removed at a later time in order to form other numerals.

In another embodiment, perforated segments are used and are patterned to form the digital numeral eight so that a user would simply "punch out" selected segments to form the numeral desired. Other patterns can also be used. The perforations themselves can be of a variety of shapes and the base portion in which the perforations are formed can be made from any material that is perforatable such as cardboard, construction board, vinyl and the like, and should be treated to resist the weather.

In yet another embodiment, the segments are die cut or stamped in the shape of the numeral eight (or other pattern) so that the user peels off selected segments to produce the desired numeral, with the other segments being left in place. The material used can be any suitable material that can be die cut or stamped such as vinyl, or another thin substrate with adhesive properties or an adhesive backing, so as to adhere to the translucent back until the selected segments are removed.

Finally, in a further embodiment, computer cut vinyl or the like can be used wherein a user would employ an automated computer sign cutter system for cutting out logos, address, names or any other graphic or image display. This can be done using, e.g., sign vinyl, and the cutting can be carried out with a computer controlled cutting plotter to create the desired logos, images, designs and/or alphanumeric figures.

Although the present invention has been described relative to specific exemplary embodiments thereof, it will be understood by those skilled in the art that other variations and modifications can be effected in these exemplary embodiments without departing from the scope and spirit of the invention.

What is claimed is:

1. In combination, a doorbell control assembly adapted to be connected to existing wiring of a doorbell unit, and a display device for displaying alphanumeric characters and powered through said doorbell control assembly, said display device comprising:

a housing module including a cover having a window therein;

a thin, substantially flat carrier element mounted within said housing module and displaying alphanumeric characters through said window in said cover, at least part of said carrier element being at least partially light transmissive;

at least one lamp disposed within said housing module behind said carrier element to provide illumination thereof, and reflector means, comprising a thin, substantially flat reflector element disposed within said housing module in back of said at least one lamp, for directing light from said at least one lamp so as to provide illumination of said carrier element, said reflector element including a plurality of formed cavities therein and at least some of said alphanumeric characters of said carrier element are individually disposed in registration with said cavities, and said cavities of said reflector element including stepped reflective side walls.

2. The combination claimed in claim 1 wherein housing module includes a frame member, and said cover is pivotably secured to said frame member so as to be pivotable between a first, normal position in engagement with said frame member and a second, lowered position that enables said carrier element to be inserted into said housing module, said housing module further comprises a rear frame member secured to said cover and the first mentioned frame member.

3. The combination claimed in claim 1 wherein said characters are seven segment numerical representations and said cavities each include a central transverse bar having stepped reflective side walls so that the reflective side walls defining said cavities are of a shape substantially that of a squared-off numeral eight, and wherein said at least one lamp comprises a pair of lamps provided for each of said cavities and are disposed on opposite sides of said transverse bar.

4. The combination claimed in claim 1 wherein said carrier element is part of a sandwich assembly further comprising at least one protective sheet for providing protection of the carrier element against weather and ultraviolet rays.

5. The combination claimed in claim 1 wherein the combination further comprises an electrical cable interconnecting said display device and said doorbell control assembly and wherein said doorbell control assembly comprises:

a housing;

a circuit board contained within said housing and including terminals connected to said cable and adapted to be connected to the door bell unit;

a first actuator mounted within said housing and extending outwardly therefrom so as to be depressible by a user;

first contact means, disposed within said housing, for, responsive to said first actuator being depressed, engaging said terminals and causing an electrical circuit to be completed to said doorbell unit;

a second actuator mounted within said housing and extending outwardly therefrom so as to be depressible by user;

a lamp mounted within said housing;

light guide means for directing light from said lamp below said housing;

second contact means, disposed within said housing, for, responsive to said second actuator being depressed, completing a circuit including said lamp so as to provide energization of said lamp.

6. The combination claimed in claim 5 further comprising a second lamp disposed within said housing behind said second actuator for, when energized, illuminating said second actuator and a further lamp disposed within said housing behind said first actuator for, when energized, illuminating said first actuator, said light guide means including a light focussing lens disposed at an inclined angle with respect to said housing and a reflector positioned behind the first-mentioned lamp.

7. In combination, a doorbell control assembly adapted to be connected to existing wiring of a doorbell unit, and a display device for displaying alphanumeric characters and powered through said doorbell control assembly, said display device comprising:

a housing module including a cover having a window therein;

a thin, substantially flat carrier element mounted within said housing module and displaying alphanumeric characters through said window in said cover, at least part of said carrier element being at least partially light transmissive;

illumination means, comprising a plurality of light sources and disposed within said housing module in substantially offset relation with respect to said alphanumeric characters of said carrier element, for providing illumination of said carrier element; and reflector means, disposed within said housing module, for directing light from said illumination means so as to provide substantially uniform illumination of said carrier element, said reflector means comprising at least one cavity formed within said housing module and disposed behind said carrier element, said cavity having at least one inclined wall defining a reflective surface and disposed relative to said illumination means so as to intercept light from said illumination means over said reflective surface to thereby provide substantially even reflection of light from said illumination means onto said carrier element so as to produce substantially even illumination of said alphanumeric characters.

8. The combination claimed in claim 7 wherein said plurality of light sources comprises a plurality of bulbs connected in series.

9. The combination claimed in claim 8, wherein said plurality of light bulbs comprises a plurality of incandescent light bulbs disposed along one edge of the module.

10. The combination claimed in claim 8, wherein said plurality of light bulbs comprises a plurality of incandescent light bulbs disposed along both edges of said module.

11. The combination claimed in claim 8, further comprising a lens strip for focusing light from said plurality of light bulbs onto said reflective surface.

12. The combination claimed in claim 10, wherein said cavity includes two inclined walls defining a pair of reflective surfaces and said incandescent light bulbs are disposed along respective edges of said reflective surfaces.

13. The combination claimed in claim 12, wherein said inclined walls meet along a common apex.

14. The combination claimed in claim 13, further comprising a lens strip for focusing light from said incandescent bulbs onto said reflective surfaces.

15. A doorbell control assembly adapted to be connected to a doorbell unit, said doorbell control assembly comprising:

a housing;

a circuit board contained within said housing and including terminals adapted to be connected to the doorbell unit;

a first actuator mounted within said housing and extending outwardly therefrom so as to be depressible by a user;

first contact means, disposed within said housing, for, responsive to said first actuator being depressed, engaging said terminals and causing an electrical circuit to be completed to said doorbell unit;

a second actuator mounted within said housing and extending outwardly therefrom so as to be depressible by a user;

a lamp mounted within said housing;

light guide means for directing light from said lamp below said housing;

second contact means, disposed within said housing, for, responsive to said second actuator being depressed, completing a circuit including said lamp so as to provide energization of said lamp;

a second lamp disposed within said housing behind said second actuator for, when energized, illuminating said second actuator; and a further lamp disposed within said housing behind said first actuator for, when energized, illuminating said first actuator.

16. An assembly as claimed in claim 15 wherein said light guide means includes a light focussing lens disposed at an inclined angle with respect to said housing and a reflector positioned behind the first-mentioned lamp.

17. An assembly as claimed in claim 15 wherein said assembly further includes an associated address display device for displaying alpha-numeric representations of the address at which the assembly is to be used and including an electrical circuit including at least one lamp for illuminating said alpha-numeric representations, said circuit board including a fuse connected in series with said electrical circuit.

18. An assembly as claimed in claim 17 wherein said housing and said display device are integrally mounted.

19. In combination, a doorbell control assembly adapted to be connected to existing wiring of a doorbell unit, and a display device for displaying alphanumeric characters and powered through said doorbell control assembly, said display device comprising:

a housing module including a cover having a window therein;

a thin, substantially flat carrier element mounted within said housing module and displaying alphanumeric characters through said window in said cover, at least part of said carrier element being at least partially light transmissive;

at least one lamp disposed within said housing module behind said carrier element to provide illumination thereof; and reflector means, comprising a thin, substantially flat reflector element disposed within said housing module in back of said at least one lamp, for directing light from said at least one lamp so as to provide illumination of said carrier element;

said combination further comprising an electrical cable interconnecting said display device and said doorbell control assembly, and said doorbell control assembly comprising:

a housing;

a circuit board contained within said housing and including terminals connected to said cable and adapted to be connected to the door bell unit;

a first actuator mounted within said housing and extending outwardly therefrom so as to be depressible by a user;

first contact means, disposed within said housing, for, responsive to said first actuator being depressed, engaging said terminals and causing an electrical circuit to be completed to said doorbell unit;

a second actuator mounted within said housing and extending outwardly therefrom so as to be depressible by user;

a lamp mounted within said housing;

light guide means for directing light from said lamp below said housing;

second contact means, disposed within said housing, for, responsive to said second actuator being depressed, completing a circuit including said lamp so as to provide energization of said lamp;

a further lamp disposed within said housing behind said first actuator for, when energized, illuminating said first actuator;

said light guide means including a light focussing lens disposed at an inclined angle with respect to said housing and a reflector positioned behind the first-mentioned lamp.

* * * * *